US012083648B2

(12) United States Patent
Shiu et al.

(10) Patent No.: US 12,083,648 B2
(45) Date of Patent: Sep. 10, 2024

(54) SANDPAPER REPLACEMENT SYSTEM

(71) Applicant: Taiwan Semiconductor Manufacturing Company, Ltd., Hsinchu (TW)

(72) Inventors: Yi-Fam Shiu, Toufen (TW); Cheng-Chao Tsai, Tainan (TW); Cheng-Lung Wu, Zhunan Township (TW); Chih-Hung Huang, Hsinchu (TW); Jiun-Rong Pai, Jhubei (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 323 days.

(21) Appl. No.: 17/444,602

(22) Filed: Aug. 6, 2021

(65) Prior Publication Data

US 2023/0039611 A1 Feb. 9, 2023

(51) Int. Cl.
*B24B 41/047* (2006.01)

(52) U.S. Cl.
CPC ..... *B24B 41/047* (2013.01)

(58) Field of Classification Search
CPC ..... B24B 41/047; B24B 41/005; B24B 41/00; B24B 27/0023; B24B 49/12; B24B 27/0038; B24D 9/0085
See application file for complete search history.

(56) References Cited

U.S. PATENT DOCUMENTS

| | | | | |
|---|---|---|---|---|
| 6,994,609 | B1 * | 2/2006 | Gotkis | B24B 37/26 451/41 |
| 2015/0044948 | A1 * | 2/2015 | Kottbus | B25J 11/0065 451/442 |
| 2016/0151882 | A1 * | 6/2016 | Xu | B23Q 3/155 451/458 |
| 2017/0066106 | A1 * | 3/2017 | Bosio | B24D 9/08 |
| 2018/0102268 | A1 * | 4/2018 | Sekiya | H01L 21/67288 |
| 2021/0276153 | A1 * | 9/2021 | Hayashi | B24B 27/0038 |

* cited by examiner

*Primary Examiner* — Joel D Crandall
*Assistant Examiner* — Sharonda T Felton
(74) *Attorney, Agent, or Firm* — Harrity & Harrity, LLP

(57) ABSTRACT

A system includes a loader tool to load a plate to which a sandpaper sheet is to be affixed to a surface of the plate. The system includes a sandpaper affixing tool to remove a liner from the sandpaper sheet to expose an adhesive surface of the sandpaper sheet, and to affix the sandpaper sheet to the surface of the plate using the adhesive surface of the sandpaper sheet. The system includes a flatness detector to determine whether a surface of the sandpaper sheet is sufficiently flat after the sandpaper sheet is affixed to the surface of the plate. The system includes an unloader tool to store the plate after the sandpaper sheet is affixed to the surface of the plate.

20 Claims, 15 Drawing Sheets

102/114

104

110

112

110

110

110

106

SANDPAPER REPLACEMENT SYSTEM

BACKGROUND

A probe card is used in a semiconductor testing process to provide an electrical path between a test system and circuits on a semiconductor wafer, thereby permitting testing and validation of the circuits at the wafer-level. During a semiconductor testing process that uses a probe card, by-product molecules or particles can become attached to probes (i.e., contact elements) of the probe card. The presence of by-product molecules or particles can cause errors in the semiconductor testing process. To avoid such errors, a sandpaper sheet is periodically used to grind the probes of the probe card to remove the by-product molecules or particles.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
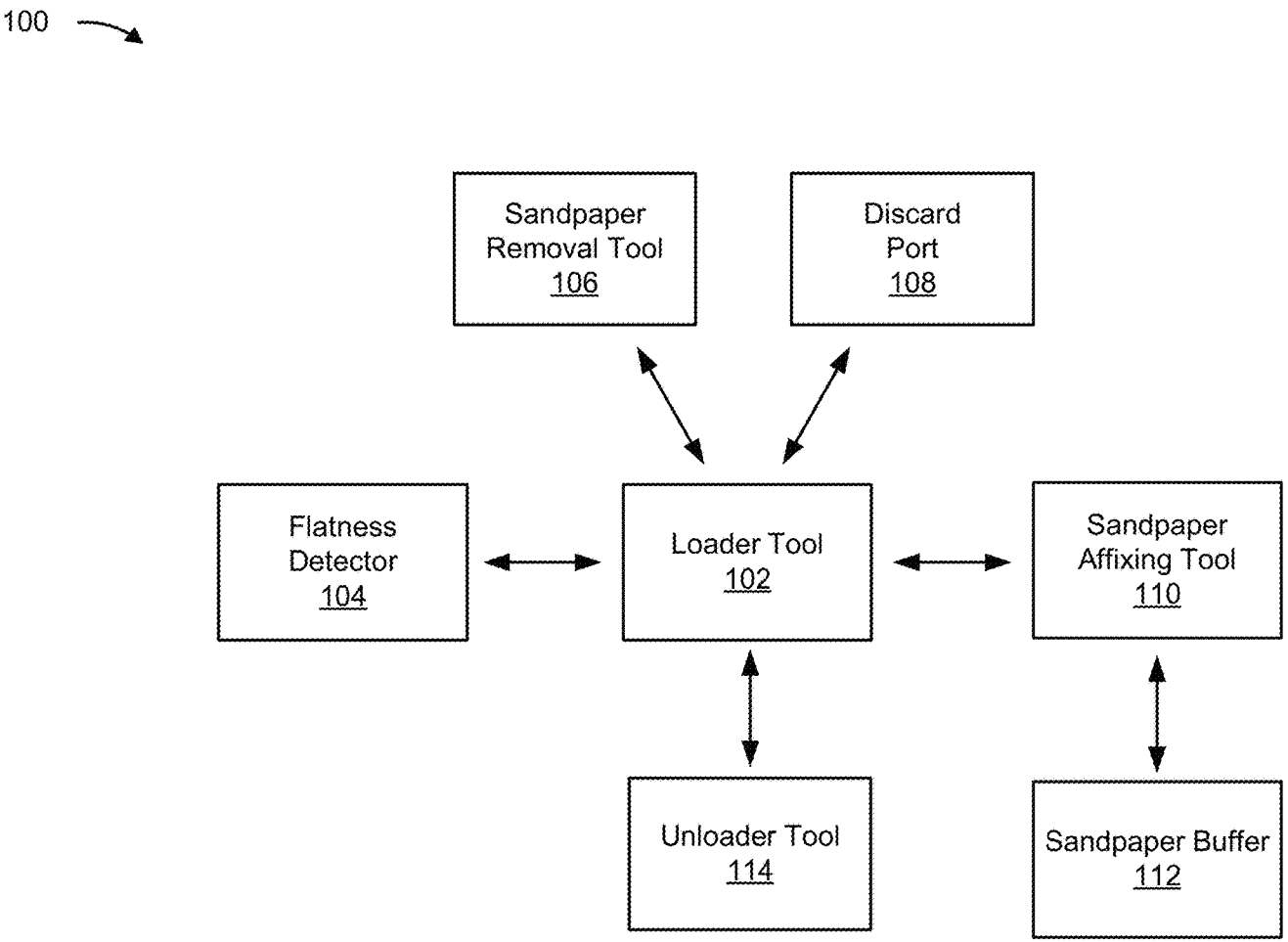
FIG. 1 is a diagram of an example sandpaper replacement system described herein.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

As described above, a sandpaper sheet can be used to grind probes of a probe card to remove by-product molecules or particles in order to avoid errors in a semiconductor testing process. Generally, the sandpaper sheet is affixed to a plate (e.g., a metal plate), and the sandpaper sheet is grinded against the probes while the sandpaper sheet is affixed to the plate. A procedure for affixing the sandpaper sheet to the plate or replacing a sandpaper sheet already affixed to the plate is performed by hand. For example, to replace a used sandpaper sheet, a person manually removes and discards the used sandpaper sheet from the plate, removes a liner from a new sandpaper sheet to expose an adhesive, and affixes the new sandpaper sheet to the plate with the adhesive. Next, the person uses a hand roller to flatten the new sandpaper sheet on the plate, and then uses an air gun to clean the new sandpaper sheet. The person then visually inspects the new sandpaper sheet to confirm whether the new sandpaper sheet is sufficiently flat against the plate.

However, this process is not only wasteful in terms of manpower, but also results in quality issues. For example, the visual inspection by the person may in some cases fail to identify one or more areas in which the new sandpaper sheet is not sufficiently flat against the metal plate such that by-product molecules or particles may not be adequately removed from probes of a probe card, thereby resulting in quality problems in association with using the probes of the probe card for semiconductor testing.

Some implementations described herein provide a sandpaper replacement system. In some implementations, the sandpaper replacement system may be used to automatically (i.e., without human intervention) remove a used sandpaper sheet from a plate, affix a new sandpaper sheet to the plate, and determine whether the new sandpaper sheet is sufficiently flat against the plate. Additionally, the sandpaper replacement system may be used to automatically affix a sandpaper sheet to a plate (e.g., when no sandpaper sheet is already affixed to the metal plate), and determine whether the sandpaper sheet is sufficiently flat against the plate.

The sandpaper replacement system not only conserves manpower that would otherwise be consumed in replacing sandpaper sheets, but also improves quality associated with semiconductor testing. For example, the sandpaper replacement system may more repeatably and reliably remove a used sandpaper sheet from a plate, affix a new sandpaper sheet to the plate, and flatten the new sandpaper sheet against the plate (as compared to these actions being performed by a person). As a result, the sandpaper replacement system may ensure that a sandpaper sheet is sufficiently mounted such that by-product molecules or particles can be adequately removed from probes of a probe card, thereby improving quality in association with using the probes of the probe card for semiconductor testing.

FIG. 1 is a diagram of an example sandpaper replacement system 100 described herein. As shown in FIG. 1, sandpaper replacement system 100 may include a plurality of tools including a loader tool 102, a flatness detector 104, a sandpaper removal tool 106, a discard port 108, a sandpaper affixing tool 110, a sandpaper buffer 112, an unloader tool 114, among other examples. The tools included in sandpaper replacement system 100 may be included in a semiconductor clean room, a semiconductor foundry, a semiconductor foundry, a semiconductor processing and/or manufacturing facility, among other examples.

The loader tool 102 includes one or more devices capable of loading a plate (e.g., a metal plate) into the sandpaper replacement system 100 (e.g., a plate to which a sandpaper sheet is to be affixed to a surface of the plate) and/or transporting the plate among tools of the sandpaper replacement system 100. For example, in some implementations, the loader tool 102 may include a magazine that stores plates and a platform capable of retrieving plates from the magazine and moving in multiple directions (e.g., an x-direction, a y-direction, and/or z-direction). Here, the loader tool 102 may lift the plate from the magazine and place the plate on a conveyor of a given tool of the sandpaper replacement system 100. In some implementations, the loader tool 102 may include a mobile robot, a robot arm, a tram or rail car, an overhead hoist transfer (OHT) vehicle, an automated material handling system (AMHS), and/or another type of tool that can be used to load a plate and/or transport the plate between other tools of the sandpaper replacement system 100. In some implementations, the loader tool 102 may be a programmed tool to travel a particular path and/or may operate semi-autonomously or autonomously.

In some implementations, the loader tool 102 may be capable determining whether a sandpaper sheet is affixed to a surface of the plate (e.g., at the time that the loader tool 102 is loading the plate into the sandpaper replacement system 100). For example, the loader tool 102 may include a sensor (e.g., an optical sensor) configured to determine a characteristic (e.g., a color, a pattern, a texture, among other examples) of an exposed surface of the plate. Here, the loader tool 102 may determine whether another sandpaper sheet (e.g., a used sandpaper sheet) is affixed to the surface plate based on the characteristic of the surface of the plate (e.g., based on a color detected by the sensor, a pattern detected by the sensor, a texture detected by the sensor, among other examples).

In some implementations, if the loader tool 102 determines that that no sandpaper sheet is affixed to the surface of the plate, then the loader tool 102 may provide the plate to the sandpaper affixing tool 110 (e.g., such that a sandpaper sheet can be affixed to the surface of the plate). In some implementations, the loader tool 102 may provide the plate to the flatness detector 104 (e.g., such that flatness of the surface of the plate can be evaluated), and may then provide the plate to the sandpaper affixing tool 110 (e.g., when the flatness detector 104 determines that the surface of the plate is sufficiently flat) or to the discard port 108 (e.g., when the flatness detector 104 determines that the surface of the plate is not sufficiently flat).

Alternatively, if the loader tool 102 determines that another sandpaper sheet is affixed to the surface of the plate, then the loader tool 102 may provide the plate to the sandpaper removal tool 106 for removal of the other sandpaper sheet from the surface of the plate. Here, the loader tool 102 may provide the plate to the sandpaper affixing tool after the other sandpaper sheet has been removed from the surface of the plate by the sandpaper removal tool 106. In some implementations, the loader tool 102 may provide the plate to the flatness detector 104 (e.g., such that flatness of the surface of the plate can be evaluated) after removal of the other sandpaper sheet, and may then provide the plate to the sandpaper affixing tool 110 (e.g., when the flatness detector 104 determines that the surface of the plate is sufficiently flat) or to the discard port 108 (e.g., when the flatness detector 104 determines that the surface of the plate is not sufficiently flat).

In some implementations, the loader tool 102 may be configured to provide the plate to the flatness detector 104 after a sandpaper sheet is affixed to the surface of the plate (e.g., to permit the flatness detector 104 to determine whether the surface of the sandpaper sheet is sufficiently flat after the sandpaper sheet is affixed to the surface of the plate). In some implementations, the loader tool 102 may then provide the plate to the unloader tool 114 (e.g., when the flatness detector 104 determines that the surface of the sandpaper sheet is sufficiently flat) or to the discard port 108 (e.g., when the flatness detector 104 determines that the surface of the sandpaper sheet is not sufficiently flat).

The flatness detector 104 includes one or more devices capable of determining whether a surface is sufficiently flat. For example, the flatness detector 104 may be capable of determining whether a surface of the sandpaper sheet is sufficiently flat after the sandpaper sheet is affixed to the surface of the plate. As another example, the flatness detector 104 may be capable of determining whether a surface of the plate is sufficiently flat prior to the sandpaper sheet being affixed to the surface of the plate. In some implementations, the flatness detector 104 may include an optical sensor (e.g., a three-dimensional (3D) laser scanner) configured to determine heights (e.g., relative to a reference height) at various points across a surface scanned by the optical sensor. In one example, the flatness detector 104 may determine heights across the surface of the plate (prior to the sandpaper sheet being affixed) and may determine, based on the heights, whether a height variation across the surface of the plate satisfies (e.g., is less than or equal to) a plate surface variation threshold. In another example, the flatness detector 104 may determine heights across the surface of the sandpaper sheet (after the sandpaper sheet is affixed) and may determine, based on the heights, whether a height variation across the surface of the sandpaper sheet satisfies (e.g., is less than or equal to) a sandpaper sheet surface variation threshold.

In some implementations, the threshold (e.g., the plate surface variation threshold, the sandpaper sheet surface variation threshold) may be approximately 5 micrometers (μm). Thus, in some implementations, the flatness detector 104 may be configured to determine that a given surface is sufficiently flat when a height variation of the given surface is less than or equal approximately 5 μm and, conversely, may be configured to determine that the given surface is not sufficiently flat when the height variation of the given surface is greater than approximately 5 μm. In some implementations, a height variation of approximately 5 μm may be used in order to ensure adequate sanding of probes of a probe card used in a semiconductor testing process.

The sandpaper removal tool 106 includes one or more devices capable of removing another sandpaper sheet from the surface of the plate prior to the sandpaper sheet being affixed to the surface of the plate. For example, the sandpaper removal tool 106 may be capable of removing a used sandpaper sheet from the surface of the plate so that a new sandpaper sheet can be affixed to the surface of the plate. In some implementations, the sandpaper removal tool 106 includes at least one angled gripper element to gradually remove the other (used) sandpaper sheet from the surface of the plate as the plate moves through (e.g., along a track of) the sandpaper removal tool 106. In some implementations, the sandpaper removal tool 106 is oriented to permit the other sandpaper sheet to be pulled from the surface of the plate at a non-zero angle. In some implementations, pulling the other sandpaper sheet from the plate at a non-zero angle serves to reduce a likelihood of the other sandpaper sheet breaking or tearing during removal by the sandpaper removal tool 106. Additional details regarding operation of the sandpaper removal tool 106 are described below with respect to FIG. 4.

The discard port 108 includes one or more devices capable of storing plates with surfaces that are not sufficiently flat or plates having sandpaper sheets with surfaces that are not sufficiently flat. For example, the discard port 108 may include a magazine that stores discarded plates. In some implementations, the loader tool 102 may be configured to load a discarded plate in the discard port 108 when the flatness detector 104 determines that the surface of the plate is not sufficiently flat or determines that the surface of the sandpaper sheet is not sufficiently flat, as described above.

The sandpaper affixing tool 110 includes one or more devices capable of removing a liner from the sandpaper sheet to expose an adhesive surface of the sandpaper sheet, and affixing the sandpaper sheet to the surface of the plate using the adhesive surface of the sandpaper sheet.

In some implementations, the sandpaper affixing tool 110 includes a liner removal component to remove the liner from the sandpaper sheet (e.g., to expose the adhesive surface of the sandpaper sheet). In some implementations, the sandpaper affixing tool 110 includes a vacuum chuck to hold the sandpaper sheet such that the adhesive surface of the sandpaper sheet is at an angle with respect to the surface of the plate. In some implementations, the sandpaper affixing tool 110 includes a vacuum stage to move the plate to cause the adhesive surface of the sandpaper sheet to be gradually pressed onto the surface of the plate. In some implementations, the sandpaper affixing tool 110 includes a pressure roller to pull the sandpaper sheet from the vacuum chuck as the vacuum stage moves the plate and to press the adhesive surface of the sandpaper sheet on the surface of the plate as the vacuum stage moves the plate beneath the pressure roller.

In some implementations, the angle at which the vacuum chuck holds the sandpaper sheet with respect to the surface of the plate is less than or equal to approximately 30 degrees. In some implementations, such an angle is used to ensure that the sandpaper sheet does not fold, bend, tear, or snap as the sandpaper sheet moves by the pressure roller of the sandpaper affixing tool 110. In some implementations, the vacuum chuck includes multiple grooves that provide at least two segmented vacuum zones. In some implementations, a height of a lowest portion of the vacuum chuck matches a height of a bottom of the pressure roller. Additional details regarding operation of the sandpaper affixing tool 110 are described below with respect to FIGS. 3A-3E.

The sandpaper buffer 112 includes one or more devices capable of storing the sandpaper sheet (e.g., prior to the sandpaper sheet being affixed to the surface of the plate) and/or providing the sandpaper sheet to the sandpaper affixing tool 110 (e.g., to enable the sandpaper sheet to be affixed to the surface of the plate). In some implementations, the sandpaper buffer 112 may include one or more compartments (e.g., four compartments).

In some implementations, when the sandpaper buffer 112 includes multiple compartments, different types of sandpaper sheets may be stored in different ones of the compartments. Thus, in some implementations, the sandpaper buffer 112 can be configured to select a type of sandpaper sheet to be provided to the sandpaper affixing tool 110. For example, in some implementations, the sandpaper buffer 112 may receive (e.g., from the unloader tool 114) an indication that an upcoming plate should be affixed with a particular type of sandpaper sheet (e.g., for the purpose of refilling a particular magazine of the unloader tool 114, as described below). Here, the sandpaper buffer 112 may select the type of sandpaper sheet to be provided to the sandpaper affixing tool 110 according to the indication (e.g., such the next sandpaper sheet provided to the sandpaper affixing tool 110 is the indicated type of sandpaper sheet).

The unloader tool 114 includes one or more devices capable of storing the plate after the sandpaper sheet is affixed to the surface of the plate. For example, in some implementations, the unloader tool 114 may include one or more magazine that store plates. In some implementations, when the unloader tool 114 includes multiple magazines, plates affixed with different types of sandpaper sheets may be stored in different ones of the magazines. In some implementations, a given magazine of the unloader tool 114 may include a sensor (e.g., an optical sensor) that detects whether a number of plates stored in the given magazine satisfies a threshold. In some implementations, if the number of plates stored in the given magazine does not satisfy the threshold (e.g., when the given magazine does not include any plates, when a number of plates stored in the given magazine is less than threshold number of plates, or the like), then the unloader tool 114 may indicate (e.g., to the sandpaper buffer 112) that an upcoming plate should be affixed with a particular type of sandpaper sheet corresponding to the given magazine. After the upcoming plate is affixed with the particular type of sandpaper sheet, as described herein, the unloader tool 114 may store the plate in the given magazine. This process can be repeated until the sensor indicates that the number of plates stored in the given magazine satisfies the threshold. In some implementations, when numbers plates stored in multiple magazines do not satisfy respective thresholds, an order in which the multiple magazines are filled may be performed in a configured order (e.g., from the right magazine to the left magazine, from high priority to lowest priority), randomized, or the like.

In some implementations, the unloader tool 114 may further include a platform capable of placing plates in the magazine and moving in multiple directions (e.g., an x-direction, a y-direction, and/or z-direction). Here, the unloader tool 114 may lift the plate from a conveyor and place the plate in the magazine. In some implementations, the unloader tool 114 may include a mobile robot, a robot arm, a tram or rail car, an OHT vehicle, an AMHS, and/or another type of tool that can be used to unload a plate. In some implementations, the unloader tool 114 may be a programmed tool to travel a particular path and/or may operate semi-autonomously or autonomously.

In one example of operation of the sandpaper replacement system 100, the loader tool 102 loads the plate and determines that another sandpaper sheet is affixed to the surface of the plate. The loader tool 102 then provides the plate to the sandpaper removal tool 106. The sandpaper removal tool 106 removes the other sandpaper sheet from the surface of the plate, and the plate is then provided to the flatness detector 104. Here, if the flatness detector 104 determines that the surface of the plate is not sufficiently flat, then the plate is provided to the discard port 108. Conversely, if the flatness detector 104 determines that the surface of the plate is sufficiently flat, then the plate is provided to the sandpaper affixing tool 110. The sandpaper affixing tool 110 removes a liner from a sandpaper sheet and affixes the sandpaper sheet to the surface of the plate. The plate is then provided to the flatness detector 104. Here, if the flatness detector 104 determines that the surface of sandpaper sheet is not sufficiently flat, then the plate is provided to the discard port 108.

Conversely, if the flatness detector 104 determines that the surface of the sandpaper sheet is sufficiently flat, then the plate is provided to the unloader tool 114.

In another example of operation of the sandpaper replacement system 100, the loader tool 102 loads the plate and determines that no sandpaper sheet is affixed to the surface of the plate. The loader tool 102 then (optionally) provides the plate to the flatness detector 104. Here, if the flatness detector 104 determines that the surface of the plate is not sufficiently flat, then the plate is provided to the discard port 108. Conversely, if the flatness detector 104 determines that the surface of the plate is sufficiently flat, then the plate is provided to the sandpaper affixing tool 110. In some implementations, if the loader tool 102 determines that no sandpaper sheet is affixed to the plate, then the plate may be provided directly to the sandpaper affixing tool 110 (rather than the flatness detector 104). The sandpaper affixing tool 110 removes a liner from a sandpaper sheet and affixes the sandpaper sheet to the surface of the plate. The plate is then provided to the flatness detector 104. Here, if the flatness detector 104 determines that the surface of sandpaper sheet is not sufficiently flat, then the plate is provided to the discard port 108. Conversely, if the flatness detector 104 determines that the surface of the sandpaper sheet is sufficiently flat, then the plate is provided to the unloader tool 114.

The number and arrangement of tools shown in FIG. 1 are provided as one or more examples. In practice, there may be additional tools, fewer tools, different tools, or differently arranged tools than those shown in FIG. 1. Furthermore, two or more tools shown in FIG. 1 may be implemented within a single tool, or a single tool shown in FIG. 1 may be implemented as multiple, distributed tools. Additionally, or alternatively, a set of tools (e.g., one or more tools) of the sandpaper replacement system 100 may perform one or more functions described as being performed by another set of tools of the sandpaper replacement system 100.

Figure 2A:
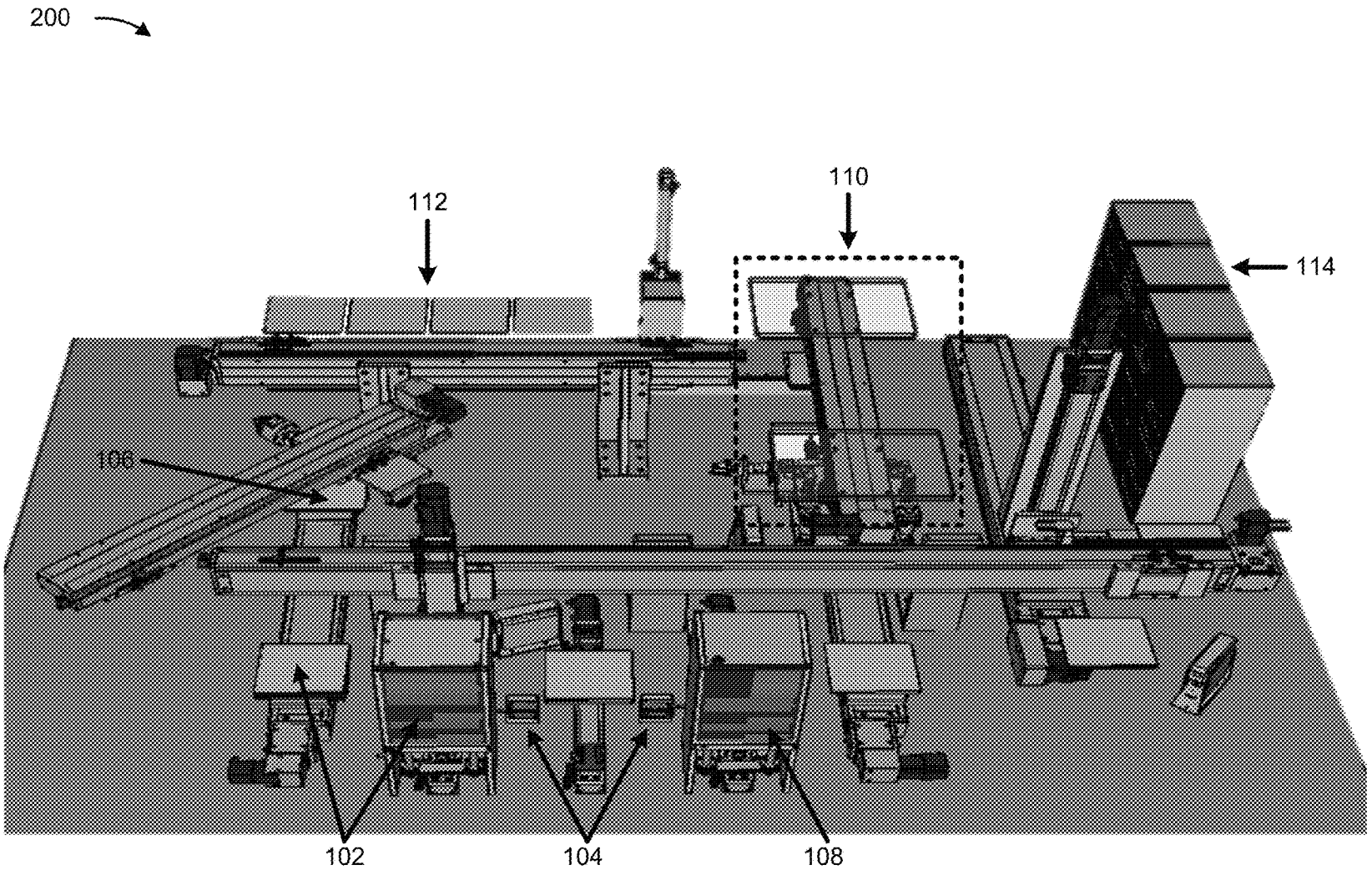
FIGS. 2A-2F are diagrams illustrating an example implementation of the sandpaper replacement system described herein.

FIGS. 2A-2F are diagrams illustrating an example implementation of the sandpaper replacement system 100 described herein. FIG. 2A is an illustration of an arrangement of the loader tool 102, the flatness detector 104, the sandpaper removal tool 106, the discard port 108, the sandpaper affixing tool 110, the sandpaper buffer 112, and the unloader tool 114 included in the sandpaper replacement system 100.

In the example shown in FIG. 2A, the various tools of the sandpaper replacement system 100 are arranged such that the loader tool 102 can load a plate and transport (e.g., using a rail shown in a horizontal direction in FIG. 2A) the plate among other tools of the sandpaper replacement system 100 in association with removing and/or affixing a sandpaper sheet to a surface of the plate. Further, in the example shown in FIG. 2A, the sandpaper buffer 112 is arranged such that the sandpaper buffer 112 can provide a sandpaper sheet to the sandpaper affixing tool 110 (e.g., near a back portion of the sandpaper affixing tool 110).

Figure 2B:
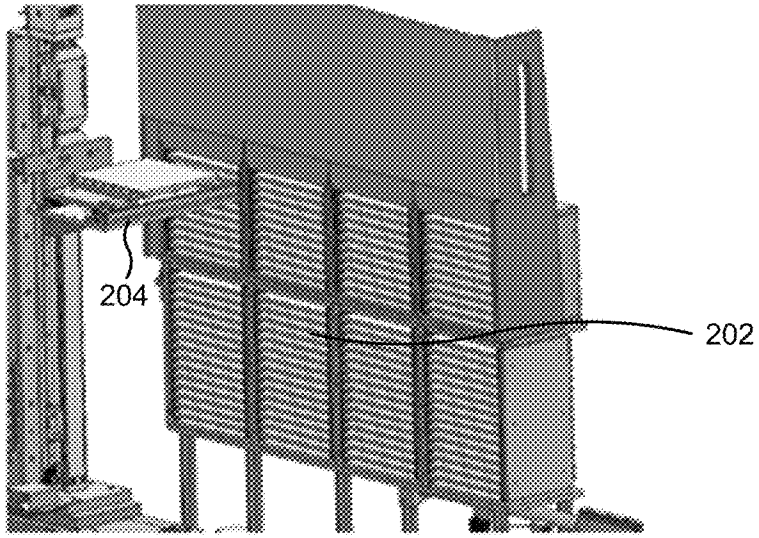

FIGS. 2B through 2F are illustrations of various tools included in the example implementation of the sandpaper replacement system 100 shown in FIG. 2A. FIG. 2B illustrates an example of the loader tool 102. As shown, the loader tool 102 may include a magazine 202 and a platform 204. As noted, the illustration shown in FIG. 2B may also be representative of the unloader tool 114.

Figure 2C:
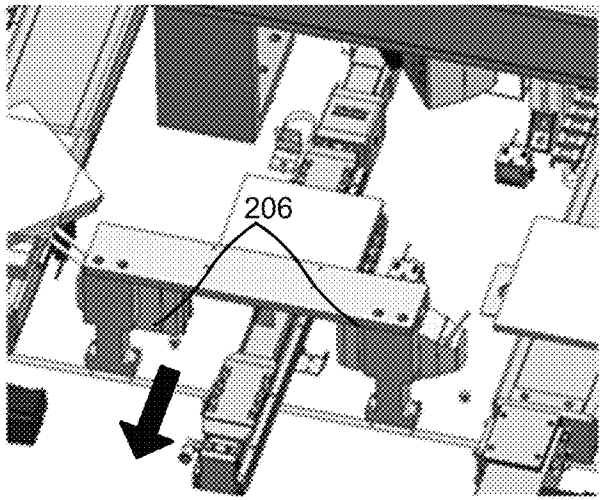

FIG. 2C illustrates an example of the flatness detector 104. As shown, the flatness detector 104 may include an optical sensor 206 associated with determining whether a surface (e.g., a surface of a plate, a surface of a sandpaper sheet) is sufficiently flat. In some implementations, the optical sensor 206 may scan the surface as the plate moves through the optical sensor (e.g., in the direction indicated in FIG. 2C).

Figure 2D:
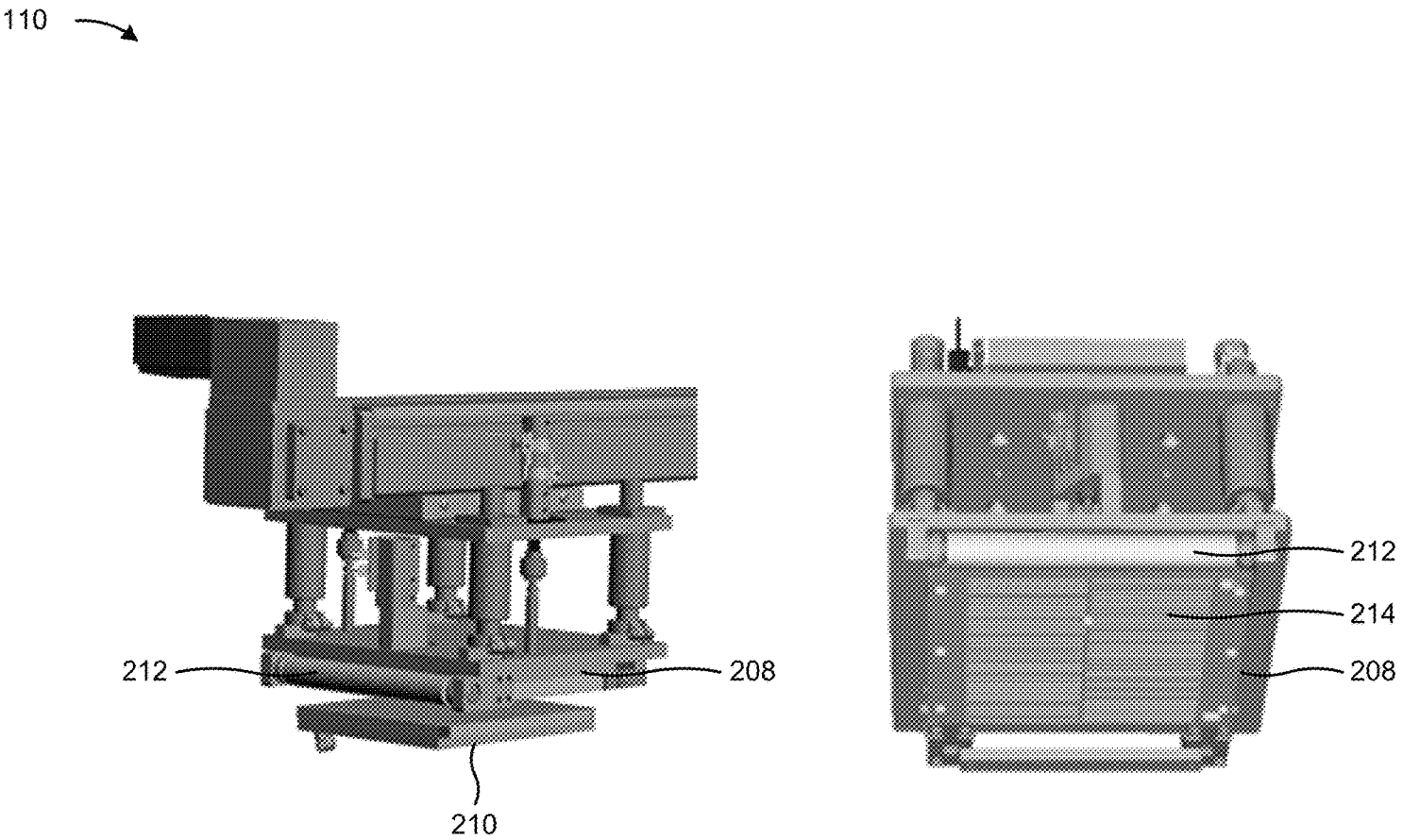
Figure 2E:
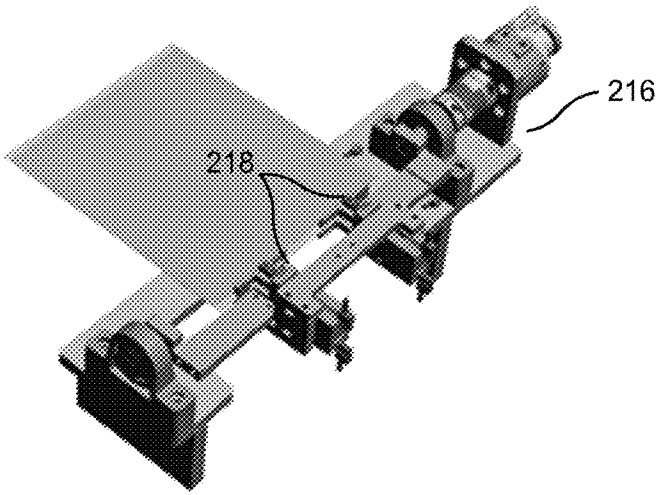

FIGS. 2D and 2E illustrate components of the sandpaper affixing tool 110. FIG. 2D illustrates isometric views of a portion of the sandpaper affixing tool 110 including a vacuum chuck 208, a vacuum stage 210, and a pressure roller 212. The left portion of FIG. 2D illustrates a first isometric view of the portion of the sandpaper affixing tool 110 (from above the vacuum chuck 208), while the right portion of FIG. 2D illustrates a second isometric view of the portion of the sandpaper affixing tool 110 (from below the vacuum chuck 208). Notably, the vacuum stage 210 is not shown in the right portion of FIG. 2D. As shown in the right portion of FIG. 2D, the vacuum chuck 208 may include multiple grooves 214 (e.g., on the bottom surface of the vacuum chuck 208). In some implementations, the multiple grooves 214 provide at least two segmented vacuum zones that enable a sandpaper sheet to be removed from the vacuum chuck 208 on a zone-by-zone basis (e.g., one zone at a time) during affixing the sandpaper sheet to the surface of the plate, as described in further detail below with respect to FIGS. 3A-3E.

FIG. 2E illustrates an example of a liner removal component 216 of the sandpaper affixing tool 110. As shown, in some implementations, the liner removal component 216 may include one or more clamps 218 that operate to remove the liner from the sandpaper sheet, as described in further detail below with respect to FIGS. 3A-3E.

Figure 2F:
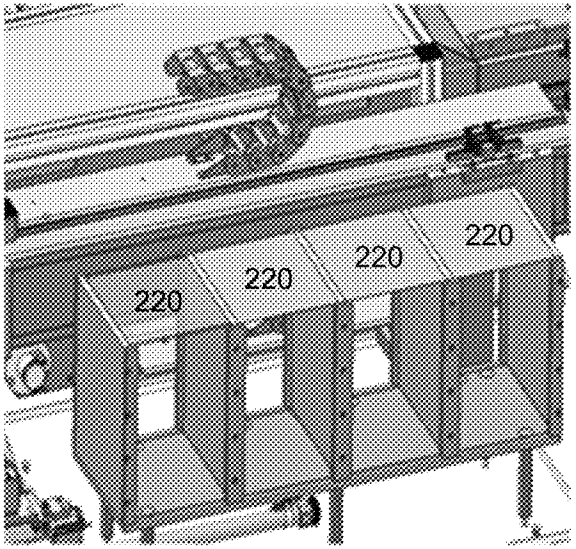

FIG. 2F illustrates an example of the sandpaper buffer 112. In the example shown in FIG. 2F, the sandpaper buffer 112 includes four compartments 220. In some implementations, a sandpaper sheet stored in one of the compartments 220 may be provided to the sandpaper affixing tool 110 for affixing to a surface of a plate.

As indicated above, FIGS. 2A-2F are provided as an example. Other examples may differ from what is described with regard to FIGS. 2A-2F. The number and arrangement of tools shown in FIGS. 2A-2F are provided as an example. In practice, there may be additional tools, fewer tools, different tools, or differently arranged tools than those shown in FIGS. 2A-2F. Furthermore, two or more tools shown in FIGS. 2A-2F may be implemented within a single tool, or a single tool shown in FIGS. 2A-2F may be implemented as multiple, distributed tools. Additionally, or alternatively, a set of tools (e.g., one or more tools) shown in FIGS. 2A-2F may perform one or more functions described as being performed by another set of tools shown in FIGS. 2A-2F.

Figure 3A:
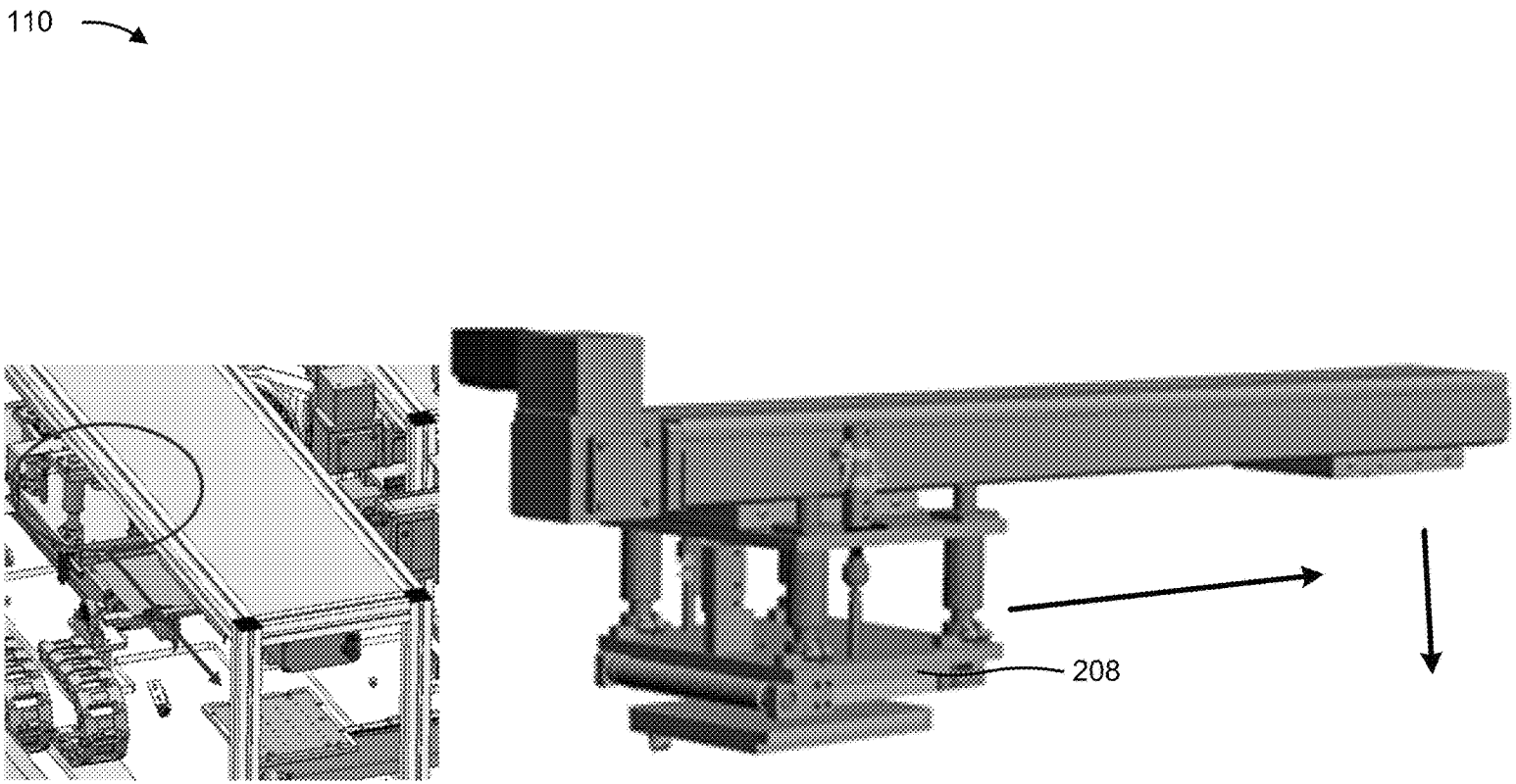
FIGS. 3A-3E are diagrams illustrating operation of the sandpaper affixing tool described herein.
Figure 3B:
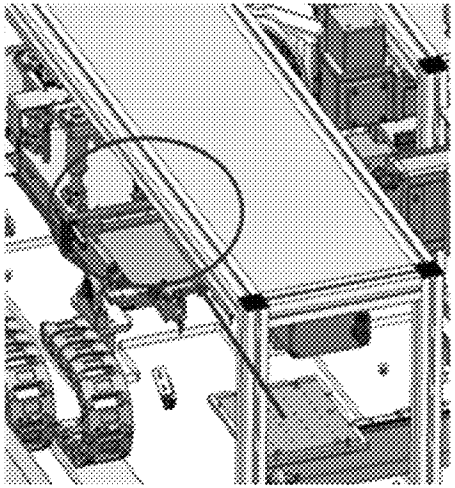
Figure 3C:
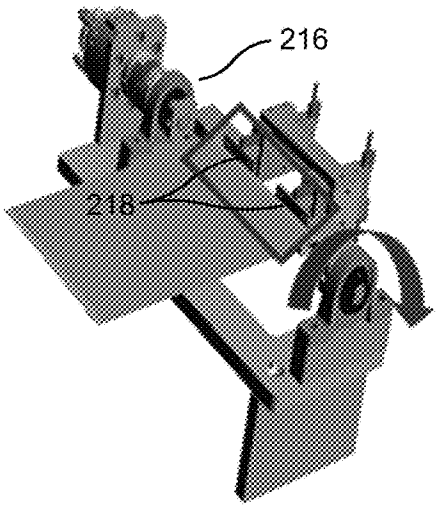
Figure 3D:
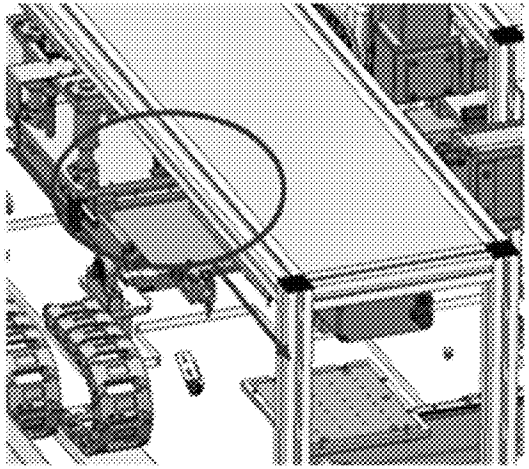

FIGS. 3A-3E are diagrams illustrating operation of the sandpaper affixing tool 110 described herein. In some implementations, as described above, the sandpaper affixing tool 110 may remove a liner from a sandpaper sheet to expose an adhesive surface of the sandpaper sheet. For example, as illustrated in FIG. 3A, the vacuum chuck 208 may move to the sandpaper buffer 112 and lower the vacuum chuck 208 to receive a sandpaper sheet from the sandpaper buffer 112 (e.g., by suctioning the sandpaper sheet to the vacuum chuck 208). Next, as indicated in FIG. 3B, the vacuum chuck 208 may move to the liner removal component 216. Here, the vacuum chuck 208 may be positioned such that clamps 218 of the liner removal component 216 can clamp an edge of the liner. Next, as indicated in FIG. 3C, the clamps 218 of the liner removal component clamp the edge of the liner, and rotate the edge of the liner (e.g., approximately 90 degrees downward), which initiates removal of the liner. Next, as indicated in FIG. 3D, the vacuum chuck may move (e.g., in a direction toward the sandpaper buffer 112) such that the liner is pulled from the sandpaper sheet (e.g., due to the clamps 218 holding the edge of the liner), thereby exposing the adhesive surface of the sandpaper sheet.

Figure 3E:
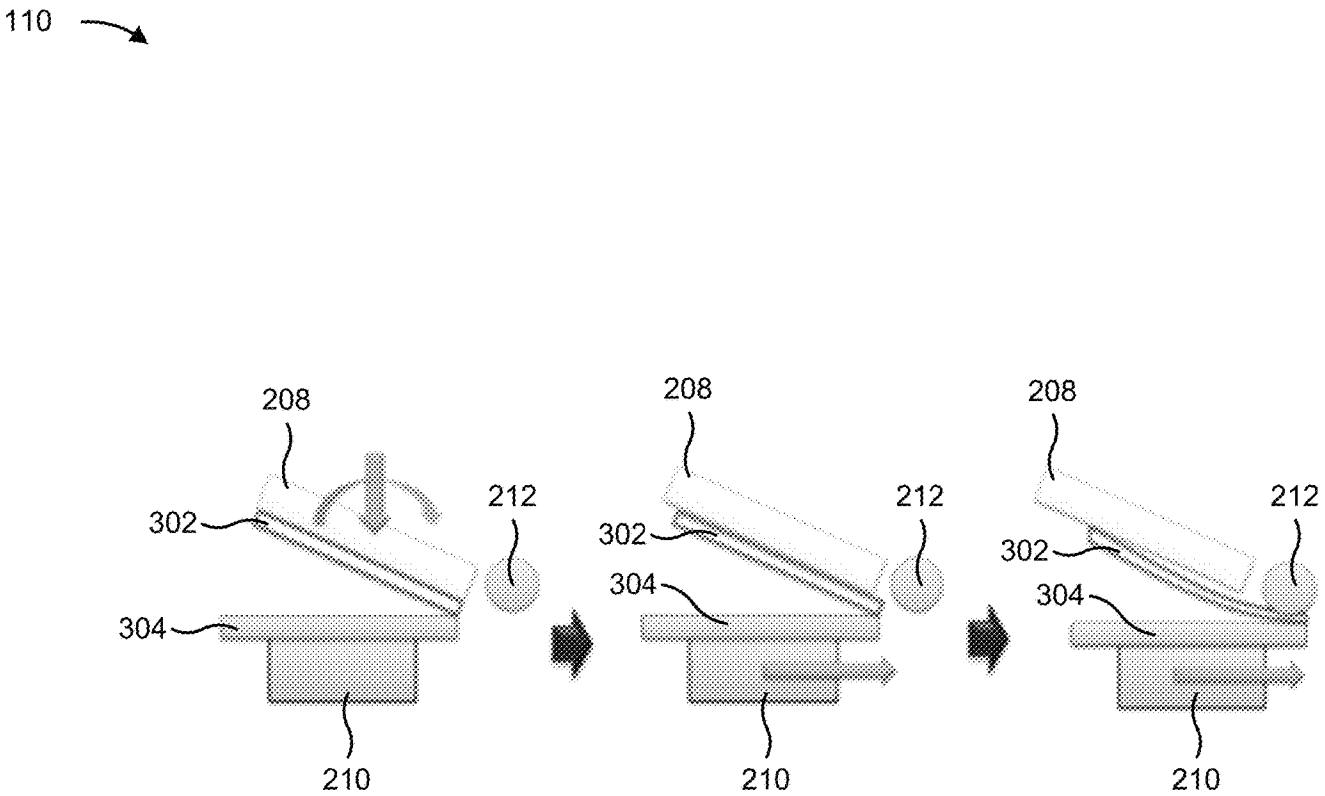

After removal of the liner, the sandpaper affixing tool 110 may carry the sandpaper sheet with the exposed adhesive surface (e.g., facing downward) to a position over the vacuum stage 210 on which the plate is being held (e.g., with a surface to which the sandpaper sheet is to be affixed facing upward). FIG. 3E illustrates an example of a sandpaper sheet 302 being affixed to a surface of a plate 304 using the adhesive surface of the sandpaper sheet 302 as performed by the sandpaper affixing tool 110. As shown in the left diagram of FIG. 3E, the vacuum chuck 208 may be angled with respect to the surface of the plate 304 (e.g., at an angle that is less than or equal to approximately 30 degrees) and may move downward such that a leading edge of the adhesive surface of the sandpaper sheet 302 is pressed to a leading edge of the surface of the plate 304. Next, as illustrated by the center diagram in FIG. 3E, the vacuum stage 210 may begin to move (e.g., laterally) with respect to the vacuum chuck 208. Here, as shown by the right diagram in FIG. 3E, as the vacuum stage 210 moves with respect to the vacuum chuck 208, the adhesive surface of the sandpaper sheet 302 is gradually pressed to the surface of the plate 304. Here, the pressure roller 212 may serve to pull the sandpaper sheet 302 from the vacuum chuck 208 as the vacuum stage 210 moves the plate 304 and may also press the adhesive surface of the sandpaper sheet 302 on the surface of the plate 304 as the vacuum stage 210 moves the plate 304 beneath the pressure roller 212.

In some implementations, as noted above, the vacuum chuck 208 includes multiple grooves 214 that provide at least two segmented vacuum zones. In the example shown in FIG. 3E, the grooves 214 extend in a direction perpendicular to the plane of the page on a bottom surface of the vacuum chuck 208. In some implementations, the grooves 214 enable the sandpaper sheet 302 to be removed from the vacuum chuck 208 on a zone-by-zone basis (e.g., one zone at a time) during affixing the sandpaper sheet 302 to the surface of the plate 304. For example, the sandpaper sheet 302 may be removed from a highest vacuum zone on the bottom surface of the vacuum chuck 208 first, followed by a next highest vacuum zone, and so on, until the sandpaper sheet 302 is fully removed from the vacuum chuck 208. In this way, the multiple grooves may be utilized to smoothly remove the sandpaper sheet 302 from the vacuum chuck 208 during affixing the sandpaper sheet 302 to the surface of the plate 304.

As indicated above, FIGS. 3A-3E are provided as an example. Other examples may differ from what is described with regard to FIGS. 3A-3E.

Figure 4:
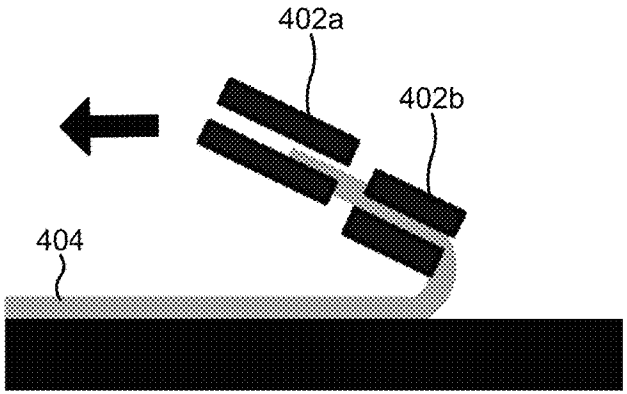
FIG. 4 is a diagram illustrating operation of the sandpaper removal tool described herein.

FIG. 4 is a diagram illustrating operation of the sandpaper removal tool 106 described herein. FIG. 4 illustrates a set of gripper elements 402 (e.g., including gripper element 402*a* and gripper element 402*b*) of the sandpaper removal tool 106. In some implementations, the set of gripper elements 402 can be used to gradually remove a sandpaper sheet 404 from a surface of a plate 304. For example, a corner of the plate 304 may have an oblique angle (e.g., a 5 mm×5 mm bevel) that causes a corner of the sandpaper sheet 404 to overhang an edge of the plate 304. Here, the gripper element 402*a* may clamp the overhanging portion of the sandpaper sheet 404 and move (e.g., in an upward direction in FIG. 4) to initiate removal of the sandpaper sheet 404 from the surface of the plate 304. Next, after the gripper element 402*a* has moved a particular distance to begin removal of the sandpaper sheet 404, the gripper element 402*b* may clamp the sandpaper sheet 404 in an area of the sandpaper sheet 404 that was pulled from the surface of the plate 304 as a result of the movement of the gripper element 402*a*. Next, the gripper elements 402*a* and 402*b* may move in a lateral direction (e.g., a leftward direction in FIG. 4) to remove the sandpaper sheet 404 from the surface of the plate 304. Notably, in some implementations, the sandpaper removal tool 106 is oriented such that the sandpaper sheet 404 is pulled from the surface of the plate 304 from the corner of the plate 304 at a non-zero angle (e.g., a 45 degree angle), which reduces a likelihood the sandpaper sheet 404 breaking or tearing during removal by the sandpaper removal tool 106.

As indicated above, FIG. 4 is provided as an example. Other examples may differ from what is described with regard to FIG. 4.

Figure 5:
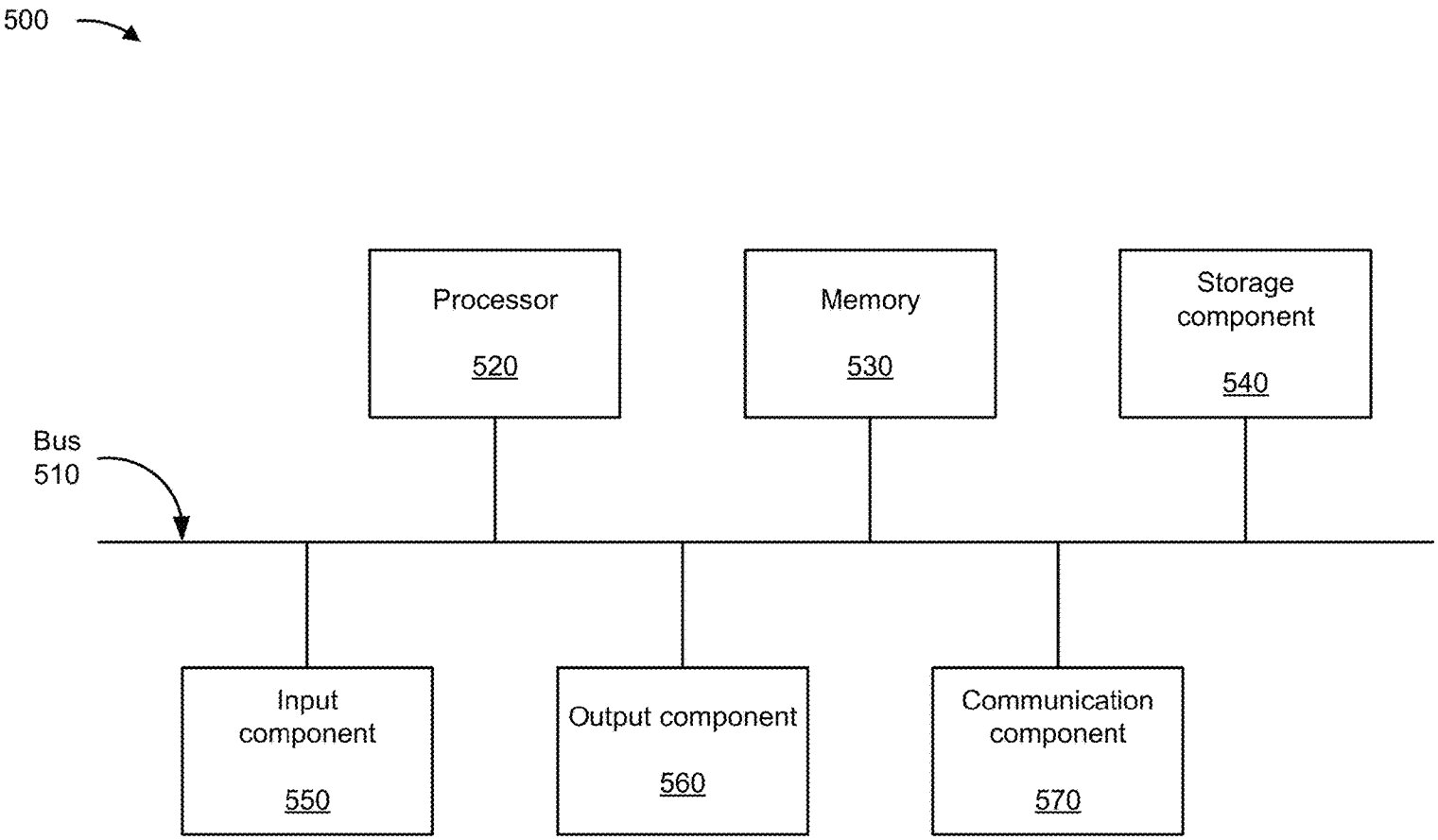
FIG. 5 is a diagram of example components of one or more devices of FIG. 1.

FIG. 5 is a diagram of example components of a device 500, which may correspond to a tool of the sandpaper replacement system 100, such as the loader tool 102, the flatness detector 104, the sandpaper removal tool 106, the discard port 108, the sandpaper affixing tool 110, the sandpaper buffer 112, and/or the unloader tool 114. In some implementations, the loader tool 102, the flatness detector 104, the sandpaper removal tool 106, the discard port 108, the sandpaper affixing tool 110, the sandpaper buffer 112, and/or the unloader tool 114 may include one or more devices 500 and/or one or more components of device 500. As shown in FIG. 5, device 500 may include a bus 510, a processor 520, a memory 530, a storage component 540, an input component 550, an output component 560, and a communication component 570.

Bus 510 includes a component that enables wired and/or wireless communication among the components of device 500. Processor 520 includes a central processing unit, a graphics processing unit, a microprocessor, a controller, a microcontroller, a digital signal processor, a field-programmable gate array, an application-specific integrated circuit, and/or another type of processing component. Processor 520 is implemented in hardware, firmware, or a combination of hardware and software. In some implementations, processor 520 includes one or more processors capable of being programmed to perform a function. Memory 530 includes a random access memory, a read only memory, and/or another type of memory (e.g., a flash memory, a magnetic memory, and/or an optical memory).

Storage component 540 stores information and/or software related to the operation of device 500. For example, storage component 540 may include a hard disk drive, a magnetic disk drive, an optical disk drive, a solid state disk drive, a compact disc, a digital versatile disc, and/or another type of non-transitory computer-readable medium. Input component 550 enables device 500 to receive input, such as user input and/or sensed inputs. For example, input component 550 may include a touch screen, a keyboard, a keypad, a mouse, a button, a microphone, a switch, a sensor, a global positioning system component, an accelerometer, a gyroscope, and/or an actuator. Output component 560 enables device 500 to provide output, such as via a display, a speaker, and/or one or more light-emitting diodes. Communication component 570 enables device 500 to communicate with other devices, such as via a wired connection and/or a wireless connection. For example, communication component 570 may include a receiver, a transmitter, a transceiver, a modem, a network interface card, and/or an antenna.

Device 500 may perform one or more processes described herein. For example, a non-transitory computer-readable medium (e.g., memory 530 and/or storage component 540) may store a set of instructions (e.g., one or more instructions, code, software code, and/or program code) for execution by processor 520. Processor 520 may execute the set of instructions to perform one or more processes described herein. In some implementations, execution of the set of instructions, by one or more processors 520, causes the one or more processors 520 and/or the device 500 to perform one or more processes described herein. In some implementations, hardwired circuitry may be used instead of or in combination with the instructions to perform one or more processes described herein. Thus, implementations described herein are not limited to any specific combination of hardware circuitry and software.

The number and arrangement of components shown in FIG. 5 are provided as an example. Device 500 may include additional components, fewer components, different components, or differently arranged components than those shown in FIG. 5. Additionally, or alternatively, a set of components (e.g., one or more components) of device 500 may perform one or more functions described as being performed by another set of components of device 500.

Figure 6:
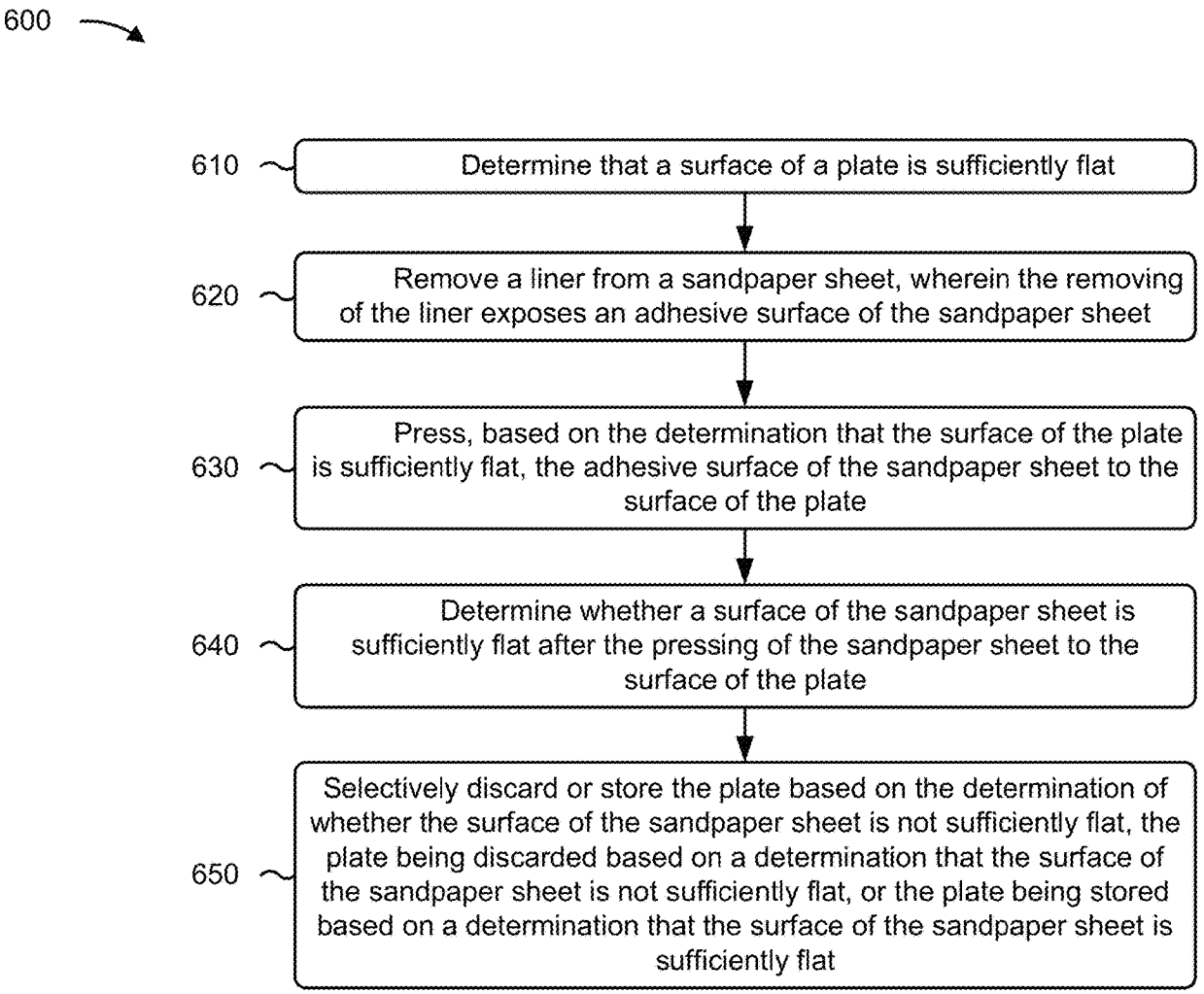
FIG. 6 is a flowchart of an example process relating to operation of the sandpaper replacement system described herein.

FIG. 6 is a flowchart of an example process 600 relating to operation of the sandpaper replacement system 100 described herein. In some implementations, one or more process blocks of FIG. 6 may be performed by a tool of the sandpaper replacement system 100, such as the loader tool 102, the flatness detector 104, the sandpaper removal tool 106, the discard port 108, the sandpaper affixing tool 110, the sandpaper buffer 112, and/or the unloader tool 114. Additionally, or alternatively, one or more process blocks of FIG. 6 may be performed by one or more components of device 500, such as processor 520, memory 530, storage component 540, input component 550, output component 560, and/or communication component 570.

As shown in FIG. 6, process 600 may include determining that a surface of a plate is sufficiently flat (block 610). For example, the sandpaper replacement system 100 (e.g., the flatness detector 104) may determine that a surface of a plate 304 is sufficiently flat, as described above.

As further shown in FIG. 6, process 600 may include removing a liner from a sandpaper sheet to expose an adhesive surface of the sandpaper sheet (block 620). For example, the sandpaper replacement system 100 (e.g., the sandpaper affixing tool 110) may remove a liner from a sandpaper sheet 302 to expose an adhesive surface of the sandpaper sheet 302, as described above.

As further shown in FIG. 6, process 600 may include pressing, based on the determination that the surface of the plate is sufficiently flat, the adhesive surface of the sandpaper sheet to the surface of the plate (block 630). For example, the sandpaper replacement system (e.g., the sandpaper affixing tool 110) may press, based on the determination that the surface of the plate 304 is sufficiently flat, the adhesive surface of the sandpaper sheet 302 to the surface of the plate 304, as described above.

As further shown in FIG. 6, process 600 may include determining whether a surface of the sandpaper sheet is sufficiently flat after the pressing of the sandpaper sheet to the surface of the plate (block 640). For example, the sandpaper replacement system 100 (e.g., the flatness detector 104) may determine whether a surface of the sandpaper sheet 302 is sufficiently flat after the pressing of the sandpaper sheet 302 to the surface of the plate 304, as described above.

As further shown in FIG. 6, process 600 may include selectively discarding or storing the plate based on the determination of whether the surface of the sandpaper sheet is sufficiently flat, the plate being discarded based on a determination that the surface of the sandpaper sheet is not sufficiently flat, or the plate being stored based on a determination that the surface of the sandpaper sheet is sufficiently flat (block 650). For example, the sandpaper replacement system (e.g., the loader tool 102) may selectively discard or store the plate 304 based on the determination of whether the surface of the sandpaper sheet 302 is sufficiently flat, the plate 304 being discarded based on a determination that the surface of the sandpaper sheet 302 is not sufficiently flat, or the plate 304 being stored based on a determination that the surface of the sandpaper sheet 302 is sufficiently flat, as described above.

Process 600 may include additional implementations, such as any single implementation or any combination of implementations described below and/or in connection with one or more other processes described elsewhere herein.

In a first implementation, pressing the adhesive surface of the sandpaper sheet 302 to the surface of the plate 304 comprises holding the sandpaper sheet 302 such that the adhesive surface of the sandpaper sheet 302 is at a non-zero angle with respect to the surface of the plate 304, moving the plate 304 to cause the adhesive surface of the sandpaper sheet 302 to be gradually pressed on the surface of the plate 304 as the plate 304 moves, and pulling the sandpaper sheet 302 from a vacuum chuck 208 as a vacuum stage 210 moves the plate 304.

In a second implementation, alone or in combination with the first implementation, the vacuum chuck 208 comprises at least two segmented vacuum zones.

In a third implementation, alone or in combination with one or more of the first and second implementations, a height of a lowest portion of the vacuum chuck 208 matches a height of a bottom of a pressure roller 212.

In a fourth implementation, alone or in combination with one or more of the first through third implementations, process 600 includes removing another sandpaper sheet 404 from the surface of the plate 304 prior to pressing the adhesive surface of the sandpaper sheet 302 to the surface of the plate 304.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

In this way, a sandpaper replacement system may be used to automatically (i.e., without human intervention) affix a sandpaper sheet to a plate (e.g., after removing another sandpaper sheet from the plate) and determine whether the sandpaper sheet is sufficiently flat against the plate. The sandpaper replacement system not only conserves manpower that would otherwise be consumed in replacing sandpaper sheets, but also improves quality associated with semiconductor testing. For example, the sandpaper replacement system may more repeatably and reliably remove a used sandpaper sheet from a plate, affix a new sandpaper sheet to the plate, and flatten the new sandpaper sheet against the plate (as compared to these actions being performed by a person). As a result, the sandpaper replacement system may ensure that a sandpaper sheet is sufficiently mounted such that by-product molecules or particles can be adequately removed from probes of a probe card, thereby improving quality in association with performing semiconductor testing.

As described in greater detail above, some implementations described herein provide a system. The system includes a loader tool to load a plate to which a sandpaper sheet is to be affixed to a surface of the plate. The system includes a sandpaper affixing tool to remove a liner from the sandpaper sheet to expose an adhesive surface of the sandpaper sheet, and to affix the sandpaper sheet to the surface of the plate using the adhesive surface of the sandpaper sheet. The system includes a flatness detector to determine whether a surface of the sandpaper sheet is sufficiently flat after the sandpaper sheet is affixed to the surface of the plate. The system includes an unloader tool to store the plate after the sandpaper sheet is affixed to the surface of the plate.

As described in greater detail above, some implementations described herein provide a method. The method includes determining, by a system, that a surface of a plate is sufficiently flat. The method includes removing, by the system, a liner from a sandpaper sheet to expose an adhesive surface of the sandpaper sheet. The method includes pressing, by the system and based on the determination that the surface of the plate is sufficiently flat, the adhesive surface of the sandpaper sheet to the surface of the plate. The method includes determining, by the system, whether a surface of the sandpaper sheet is sufficiently flat after the pressing of the sandpaper sheet to the surface of the plate. The method includes selectively discarding or storing, by the system, the plate based on the determination of whether the surface of the sandpaper sheet is sufficiently flat, the plate being discarded based on a determination that the surface of the sandpaper sheet is not sufficiently flat, or the plate being stored based on a determination that the surface of the sandpaper sheet is sufficiently flat.

As described in greater detail above, some implementations described herein provide a method. The method includes holding, by a vacuum chuck of a sandpaper affixing tool, a sandpaper sheet such that an adhesive surface of the sandpaper sheet is at an angle with respect to a surface of a plate to which the sandpaper sheet is to be affixed, moving, by a vacuum stage of the sandpaper affixing tool, the plate such that the adhesive surface of the sandpaper sheet is gradually pressed on the surface of the plate, pulling, by a pressure roller of the sandpaper affixing tool, the sandpaper sheet from the vacuum chuck as the vacuum stage moves the plate, and pressing, by the pressure roller of the sandpaper affixing tool, the adhesive surface of the sandpaper sheet on the surface of the plate as the vacuum stage moves the plate beneath the pressure roller.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A system, comprising:

a loader tool to load a plate to which a sandpaper sheet is to be affixed to a surface of the plate in association with semiconductor processing;

a sandpaper affixing tool to:

remove a liner from the sandpaper sheet to expose an adhesive surface of the sandpaper sheet, and affix the sandpaper sheet to the surface of the plate using the adhesive surface of the sandpaper sheet;

a flatness detector to determine whether a surface of the sandpaper sheet is sufficiently flat for the semiconductor processing after the sandpaper sheet is affixed to the surface of the plate; and an unloader tool to store the plate after the sandpaper sheet is affixed to the surface of the plate.

2. The system of claim 1, wherein the sandpaper affixing tool comprises:

a vacuum chuck to hold the sandpaper sheet such that the adhesive surface of the sandpaper sheet is at an angle with respect to the surface of the plate, a vacuum stage to move the plate to cause the adhesive surface of the sandpaper sheet to be gradually pressed onto the surface of the plate, and a pressure roller to pull the sandpaper sheet from the vacuum chuck as the vacuum stage moves the plate.

3. The system of claim 2, wherein the vacuum chuck comprises multiple grooves that provide at least two segmented vacuum zones.

4. The system of claim 2, wherein a height of a lowest portion of the vacuum chuck matches a height of a bottom of the pressure roller.

5. The system of claim 2, wherein the angle at which the vacuum chuck holds the sandpaper sheet with respect to the surface of the plate is less than or equal to approximately 30 degrees.

6. The system of claim 1, further comprising a sandpaper removal tool to remove another sandpaper sheet from the surface of the plate prior to the sandpaper sheet being affixed to the surface of the plate.

7. The system of claim 6, wherein the sandpaper removal tool comprises at least one angled gripper element to gradually remove the other sandpaper sheet from the surface of the plate as the plate moves through the sandpaper removal tool.

8. The system of claim 6, wherein the sandpaper removal tool is oriented to permit the other sandpaper sheet to be pulled from the surface of the plate at a non-zero angle.

9. The system of claim 1, wherein the loader tool is further to:

determine that no sandpaper sheet is affixed to the surface of the plate, and provide the plate to the sandpaper affixing tool based on the determination that no sandpaper sheet is affixed to the plate.

10. The system of claim 1, wherein the loader tool is further to:

determine that another sandpaper sheet is affixed to the surface of the plate, provide the plate to a sandpaper removal tool for removal of the other sandpaper sheet from the surface of the plate, and provide the plate to the sandpaper affixing tool after the other sandpaper sheet has been removed from the surface of the plate by the sandpaper removal tool.

11. The system of claim 1, wherein the flatness detector is further to determine that the surface of the plate is sufficiently flat prior to the sandpaper sheet being affixed to the surface of the plate.

12. The system of claim 1, further comprising a sandpaper buffer to:

store the sandpaper sheet prior to the liner being removed from the sandpaper sheet, and provide the sandpaper sheet to the sandpaper affixing tool.

13. The system of claim 1, further comprising a discard port to store one or more plates with surfaces that are not sufficiently flat or one or more plates having sandpaper sheets with surfaces that are not sufficiently flat.

14. The system of claim 1, wherein the flatness detector is configured to determine that the surface of the sandpaper sheet is sufficiently flat when a height variation of the surface of the sandpaper sheet is less than or equal to a threshold.

15. The system of claim 14, wherein the threshold is 5 micrometers.

16. The system of claim 1, wherein the flatness detector includes a sensor that is configured to determine multiple heights across the surface of the sandpaper sheet.

17. The system of claim 16, wherein the sensor includes a three-dimensional scanner configured to scan the surface of the sandpaper sheet.

18. A system, comprising:

a flatness detector configured to determine whether a surface of a plate is sufficiently flat for semiconductor processing, wherein a sandpaper sheet is to be affixed to the surface of the plate based on the determination of whether the surface of the plate is sufficiently flat, and wherein the flatness detector is further configured to determine whether a surface of the sandpaper sheet is sufficiently flat for the semiconductor processing;

a sandpaper affixing tool to affix the sandpaper sheet to the surface of the plate based on the surface of the plate being sufficiently flat, wherein the sandpaper affixing tool is configured to:

remove a liner from the sandpaper sheet to expose an adhesive surface of the sandpaper sheet, and press the adhesive surface of the sandpaper sheet to the surface of the plate; and an unloader tool to store the plate after the sandpaper sheet is affixed, based on the surface of the sandpaper sheet being sufficiently flat.

19. A system, comprising:

a loader tool to load a plate to which a sandpaper sheet is to be affixed to a surface of the plate in association with semiconductor processing;

a sandpaper affixing tool to:

affix the sandpaper sheet to the surface of the plate using an adhesive surface of the sandpaper sheet;

a flatness detector to determine, in association with one or more components, whether a surface of the sandpaper sheet is sufficiently flat for the semiconductor processing, wherein the one or more components include at least one of a processor, memory, a storage component, an input component, an output component, or a communication component; and an unloader tool to store the plate after the sandpaper sheet is affixed to the surface of the plate, based on whether the surface of the sandpaper sheet is sufficiently flat.

20. The system of claim 19, wherein the flatness detector determines whether the surface of the sandpaper sheet is sufficiently flat after the sandpaper sheet is affixed to the surface of the plate or before the sandpaper sheet is affixed to the surface of the plate.

* * * * *